US006206743B1

(12) United States Patent
Martin

(10) Patent No.: US 6,206,743 B1
(45) Date of Patent: Mar. 27, 2001

(54) LIFERAFT

(75) Inventor: Michael Martin, Lymm (GB)

(73) Assignee: Wardle Storeys (Safety & Survival Equipment) Limited, Barnoldswick (GB)

( * ) Notice: Subject to any disclaimer, the term of this patent is extended or adjusted under 35 U.S.C. 154(b) by 0 days.

(21) Appl. No.: 09/125,508

(22) PCT Filed: Jun. 11, 1997

(86) PCT No.: PCT/GB97/01580

§ 371 Date: Dec. 23, 1998

§ 102(e) Date: Dec. 23, 1998

(87) PCT Pub. No.: WO97/47518

PCT Pub. Date: Dec. 18, 1997

(30) Foreign Application Priority Data

Jun. 13, 1996 (GB) ..... 9612369
Jun. 5, 1997 (GB) ..... 9711531

(51) Int. Cl.[7] ..... B63B 35/58
(52) U.S. Cl. ..... 441/37; 441/38; 441/40
(58) Field of Search ..... 441/37–41

(56) References Cited

U.S. PATENT DOCUMENTS 3,034,154 * 5/1962 Silverstone .
3,037,218 * 6/1962 Brooks, III .
3,123,843 * 3/1964 Tangen .
3,574,875 * 4/1971 Tulett .
3,843,983 10/1974 Tangen .
5,733,158 * 3/1998 Higginbotham ..... 441/38

FOREIGN PATENT DOCUMENTS 0 087 734 * 9/1983 (EP) .
2152105 * 4/1973 (FR) .
839716 * 6/1960 (GB) .

* cited by examiner

*Primary Examiner*—Sherman Basinger
(74) *Attorney, Agent, or Firm*—Stevens, Davis, Miller & Mosher, L.L.P.

(57) ABSTRACT

A reversible liferaft having two canopies (4*a*, 4*b*), one on each side, and an inflatable column (13), which supports the upper canopy (4*a*) when the liferaft is floating on water. The column (13) preferably has a narrow center (12) and wider extremities (3*a*, 3*b*) and is positioned in an aperture (7) in the floor (2) on the liferaft. A sleeve (9) is connected at one end (10) of the edge of the aperture (7) and at the other end (11) to the center (12) of the column (13).

18 Claims, 6 Drawing Sheets

LIFERAFT

BACKGROUND OF THE INVENTION

1. Field of the Invention

This invention relates to a liferaft and in particular to a reversible liferaft, i.e. one which can be occupied satisfactorily regardless of the way it floats.

2. Description of the Related Art

There are three categories of previously known liferafts.

Firstly there are so-called open reversible or platform liferafts, most commonly used on vessels on inshore routes. These liferafts comprise either single or multiple buoyancy tubes arranged in a polygon e.g. with 8, 10 or 12 sides, surrounding a single sheet of waterproof fabric which forms a floor. Such liferafts are not supplied with any protection means such as a canopy, to protect the occupant from the environment e.g. wind and rain, although some are provided with thermal protective aids.

Secondly, there are those reversible liferafts which comprise either a single or multiple buoyancy tubes, again arranged in a polygon to surround a sheet of waterproof fabric which provides a floor. These liferafts incorporate means of attaching a separately stowed, manually erectable arch and canopy system. Action is required by the occupant (s) to erect and cause the arch system to inflate. This type of reversible liferaft is commonly stowed on commercial aircraft.

The third category comprises reversible liferafts comprising a single polygonal buoyancy tube and incorporating arch tubes which during deployment of the liferaft are restrained. The occupants need to release the arch tubes and erect the canopy. Liferafts in this category are commonly provided on helicopters.

OBJECTS AND SUMMARY OF THE INVENTION

It is an object of the present invention to provide a reversible liferaft having a canopy which is automatically deployed whichever way the liferaft floats, without the need for any erecting action by the occupant(s).

In accordance with the invention a liferaft comprises a sheet of waterproof fabric for supporting at least one person, at least one inflatable buoyancy tube secured to and surrounding the periphery of the sheet, an aperture formed in the sheet, an inflatable column of fabric having a centre and two extremities, a sleeve of waterproof fabric having two ends, the sleeve being connected at one end to the edge of the aperture in the sheet and at the other end to the outer surface of the column at or near the centre thereof, and two canopies, each comprising a sheet of fabric extending from one extremity of the column to the at least one inflatable tube and the other extending from the other extremity of the column to the at least one inflatable tube.

Preferably two inflatable buoyancy tubes are provided, one above the other, and the sheet for supporting at least one person is joined to at least one of the tubes at the line of connection between the two tubes.

Preferably the column is single—walled and has a circular horizontal cross-section when inflated and may generally have the form of two parts of cones, having a central narrow centre and wider extremities. Alternatively the column may be double-walled, i.e. comprising two tubular walls, one inside the other, parts of the two walls being joined together e.g. by welding to provide a plurality of upright flutes which add overall rigidity to the columns when inflated. The wider extremities preferably each have a substantially larger cross-sectional area than that of the centre, preferably in the ratio of about 10:1. The column may be inflatable via a single feed tube connected to the, or one of the, buoyancy tubes or via several feed tubes connected to the one buoyancy tube or both or all the buoyancy tubes (if a plurality is provided). Alternatively a separate gas inflation system e.g. a gas cylinder may be provided.

The sleeve may be of circular cross-section and of part conical form when the liferaft is inflated, having a cone angle corresponding to the cone angle of the two conical parts of the column.

One or more water pockets may be provided for stability while the liferaft is floating.

The canopies may be provided with shaping means for causing part of that canopy which is on the underside of the liferaft when floating on water to project downwards into the water, providing stabilising means for the liferaft. The shaping means may be associated with both canopies so that which ever of the two canopies is on the underside of the liferaft is caused to project downwards as described. The shaping means may, for example, comprise a plurality of elasticated ropes and weights.

The stabilising means provided when said part of each canopy is shaped by the shaping means may comprise at least one water pocket. The or each pocket may be provided with at least one hole to provide water entry and/or air exit during deployment of the liferaft and, further, may be fitted with at least one transverse bulkhead to reduce water movement.

BRIEF DESCRIPTION OF THE DRAWINGS

Two embodiments of the invention will now be described by way of example only with reference to in the accompanying drawings of which.

DETAILED DESCRIPTION OF THE PREFERRED EMBODIMENTS

Figure 1:
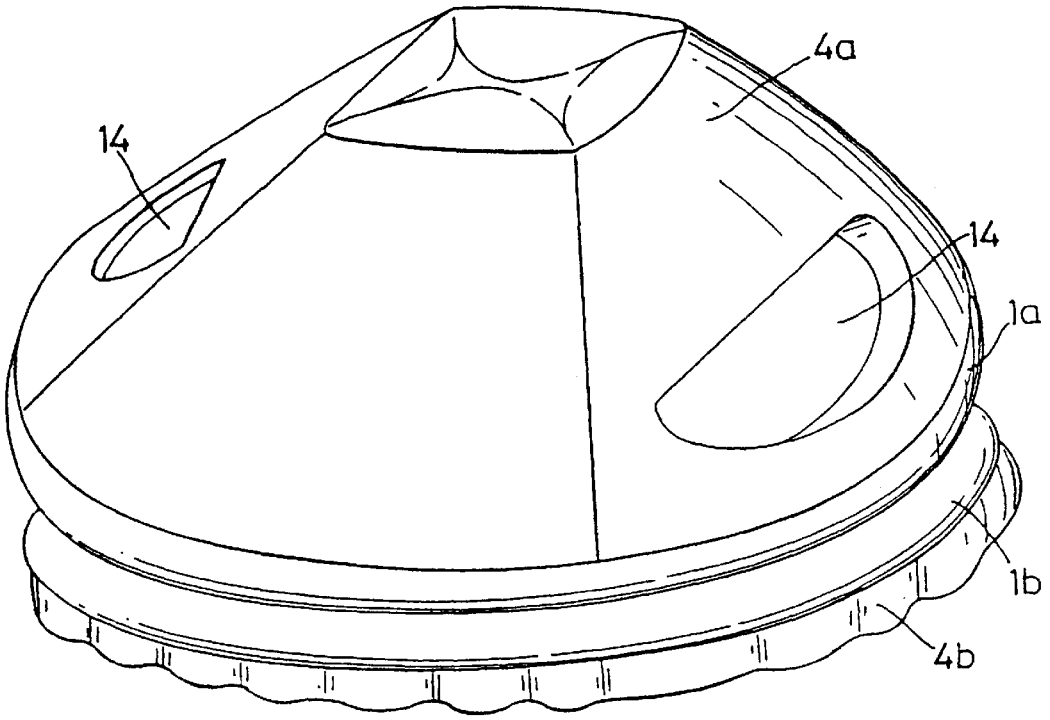
FIG. 1 shows a perspective view from above of an inflated reversible liferaft in accordance with the first embodiment of the invention.
Figure 2:
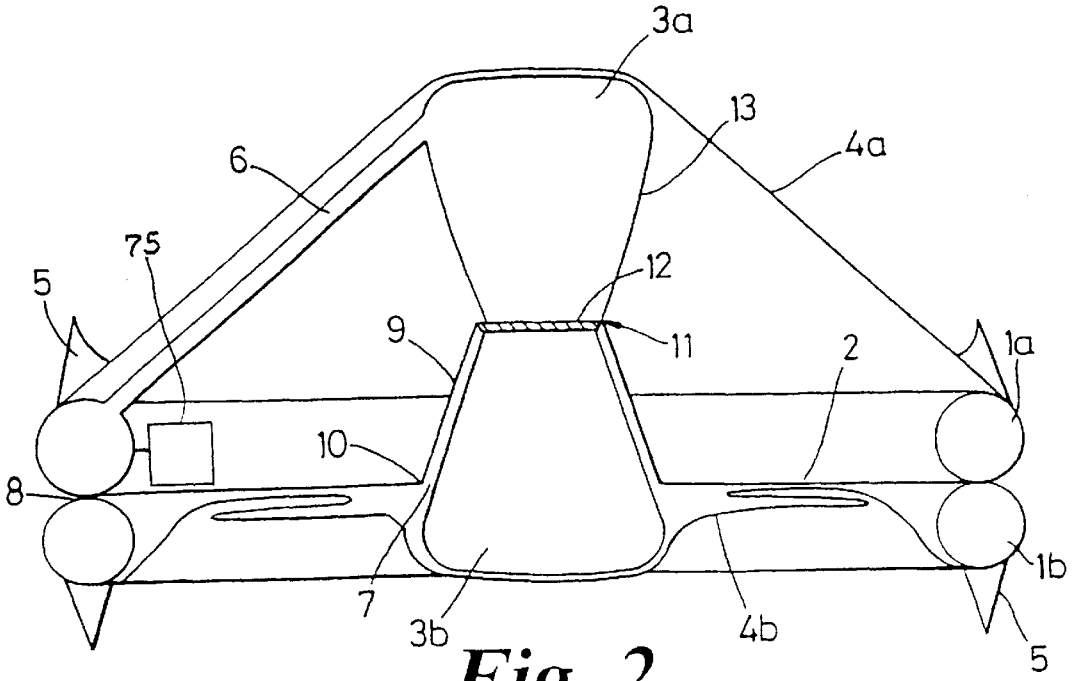
FIG. 2 shows a vertical cross-section through the liferaft shown in FIG. 1.

As shown in the FIGS. 1 and 2, the liferaft according to the first embodiment of the invention comprises two toroidal buoyancy tubes 1*a* and 1*b*, both manufactured from waterproof fabric and positioned, when inflated, one above the other. The tubes are joined together along a circular line 8 of contact. (The buoyancy tubes may alternatively be polygonal comprising for example eight, ten or twelve straight sections).

Joined to the tubes 1 at the line 8 of contact is a sheet 2 of waterproof fabric to provide a floor for an occupant of the liferaft. Automatic drains (not shown) are provided in the floor.

At the centre of the sheet 2 is a circular aperture 7 with a part conical sleeve 9 attached around its wider circular end 10 to the periphery of the aperture. The other, narrower end 11 of the sleeve 9 is attached to the centre 12 of a single-walled inflatable column 13 made of the same fabric as the tubes and floor, which, when inflated, is of circular horizontal crosssection and is in the form of two part cones, as can be seen in FIG. 2. The narrow ends of the part cones are at the centre 12 of the column and the wide ends 3*a* and 3*b* are at the top and bottom extremities respectively, as shown in FIG. 2. For stability, the wide ends 3*a* and 3*b* each have substantially larger cross-sectional areas than the centre 12, preferably in the ration of about 10:1. Thus for a circular cross-sectional column the diameter of the ends may be about 1000 mm to 2000 mm and the diameter of the centre about 300 mm to 700 mm, the ratio of diameters being about 3:1.

Small holes (not shown) are formed in the sleeve 9 adjacent the narrower end 11 in order to prevent a partial vacuum forming between the under side of the floor sheet 2 and the water surface.

Two canopies 4*a* and 4*b* are provided, each having entrances 14 through which a person can climb from the water, over the upper buoyancy tube and into the liferaft. One canopy 4*a* extends from the upper buoyancy tube 1*a* and over the top of the top extremity 3*a* of the column 13. The other canopy 4*b* is in a similar position under the liferaft extending from the bottom tube 16 and under the lower end 3*b* of the column 13. Because the liferaft is shown in FIG. 2 in the inflated state floating on water, the column 13 is forced upwards due to buoyancy forces and takes up the position shown due to the constraints applied by the sleeve 9 and the upper canopy 4*a*. The lower canopy 4*b* remains slack. A temporary restraint (not shown) is provided to hold the lower canopy 4*b* close to the underside of the floor i.e. the fabric sheet 2. A temporary restraint (not shown) is also provided for the upper canopy which will be in the position of the lower canopy if the liferaft is floating the other way up.

As shown the column 13 is connected via a flexible feed tube 6 to one (1*a*) of the two buoyancy tubes. The column 13 and the buoyancy tube 1*a* are thus both automatically inflated from the same source 75 when the liferaft is deployed in water. An automatic valve system (not shown) ensures that the tubes 1*a* and 1*b* are inflated before the column 13. Water pockets 5 are also provided on both buoyancy tubes to provide stability whichever way up the liferaft is floating.

The shape of the column in so far as it is provided with wide extremities 3*a* and 3*b* provides enhanced buoyancy for the floor sheet 2 adjacent the sleeve 9. Thus, it is unlikely that the weight of occupants close to the column will be sufficient to make the floor distort and contact the water surface or the columns to submerge sufficiently to lower the top of the column and thus collapse, or partially collapse, the upper canopy on to the occupants. Further, during inflation the forces due to buoyancy acting on the bottom of the column will be uniformly distributed so that the column will be erected vertically or, put another way, so that there is very little likelihood of the column being displaced from the vertical position.

Figure 3:
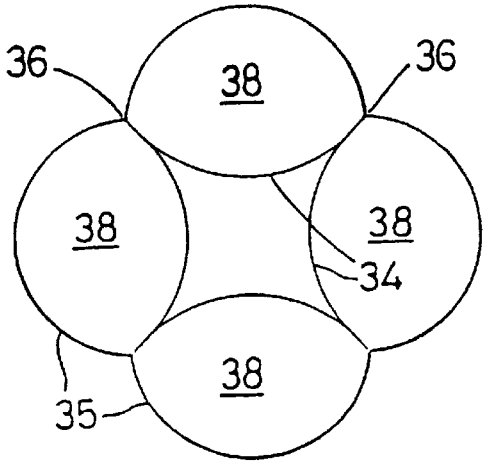
FIG. 3 shows a horizontal cross-section on line IIII—IIII of FIG. 4.
Figure 4:
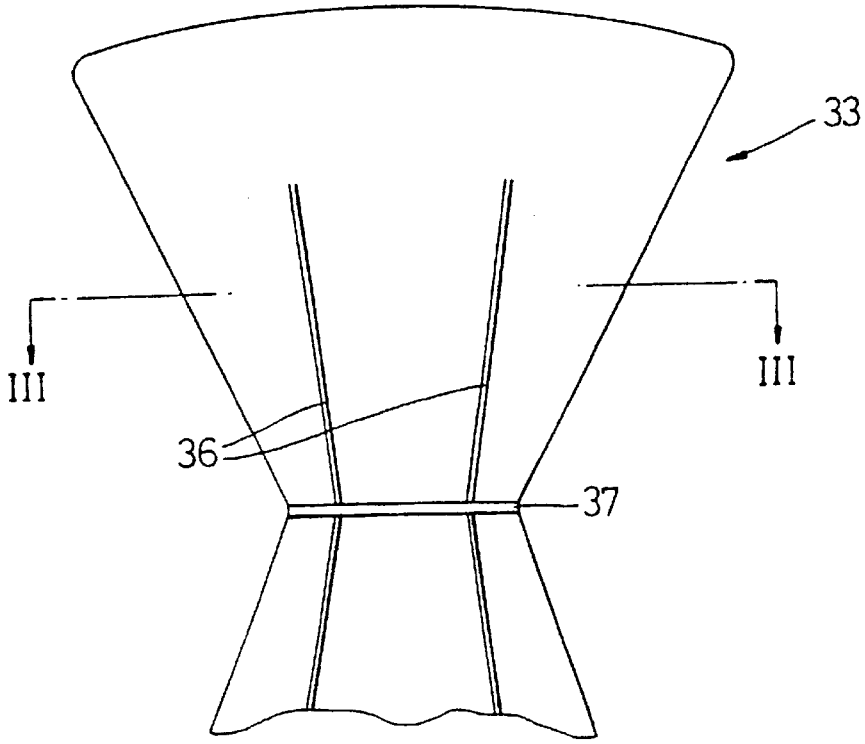
FIG. 4 shows a partial vertical cross-section of a modified form of the column of the liferaft shown in FIGS. 1 and 2.

In a modification of the first embodiment the liferaft is as shown in FIGS. 1 and 2 but has a column 33 in the form of two part cones and is tubular comprising inner and outer fabric walls 34 and 35 respectively. These are joined together by welding or any suitable adhesive along four near-vertical lines 36 which extend upwards and downwards from the narrow centre 37 for part of the overall height of the column 35 thus dividing part of the column into four chambers 38, see FIG. 3. This construction provides the outer surface of the column with four curved flutes and provides extra vertical rigidity in use.

As shown in FIGS. 5 to 8, the liferaft according to the second embodiment of the invention comprises two toroidal buoyancy tubes 50,51, both manufactured from air-holding waterproof fabric and positioned, when inflated, one above the other. The tubes are joined together along a circular line 58 of contact. (The buoyancy tubes may alternatively be polygonal comprising for example eight, ten or twelve straight sections).

Joined e.g. by adhesive or welding, to the tubes 50,51 at the line 58 of contact is a sheet 52 of waterproof fabric to provide a floor for the liferaft.

Figure 6:
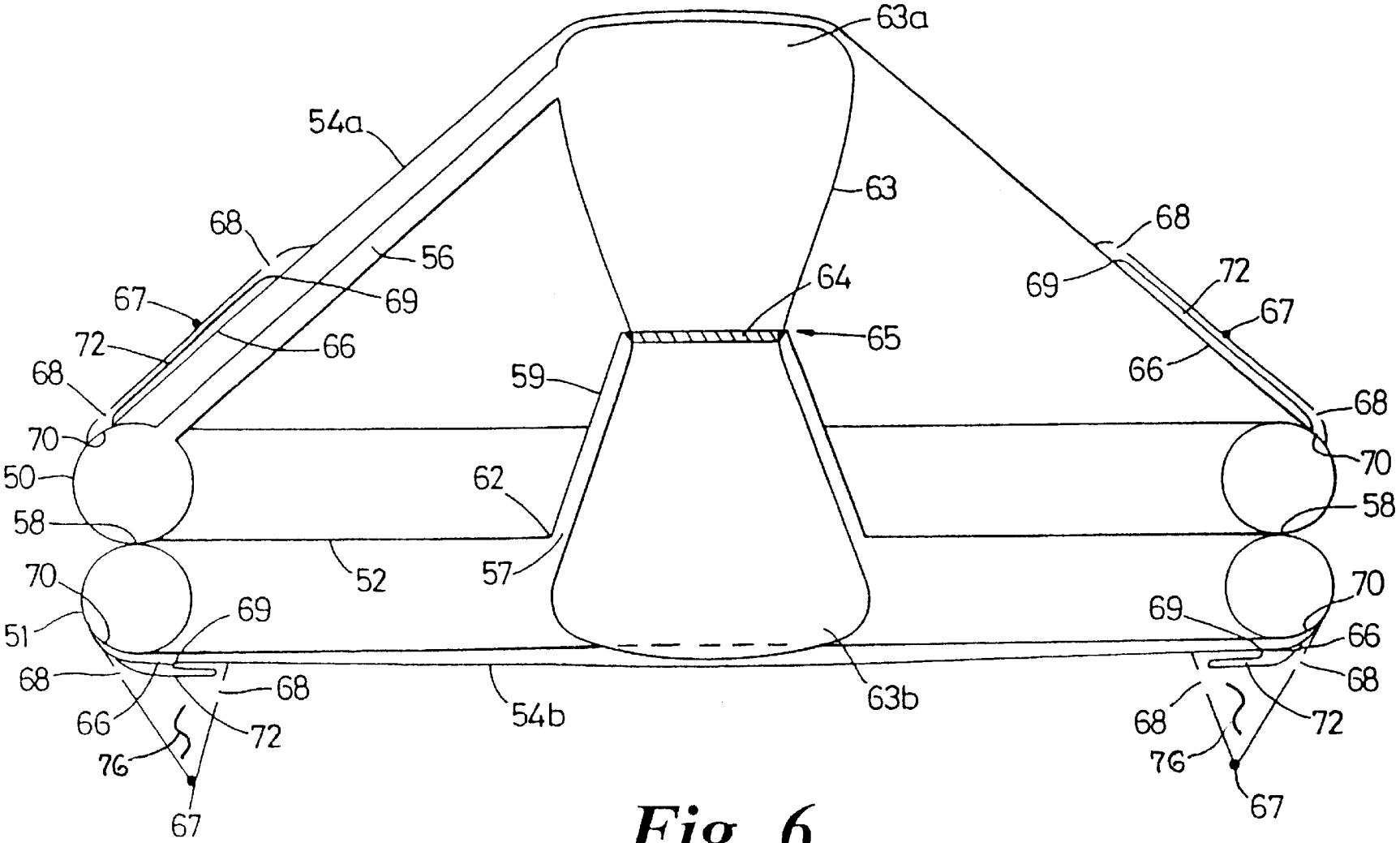
FIG. 6 shows a vertical cross-section through the liferaft shown in FIG. 5.
Figure 7:
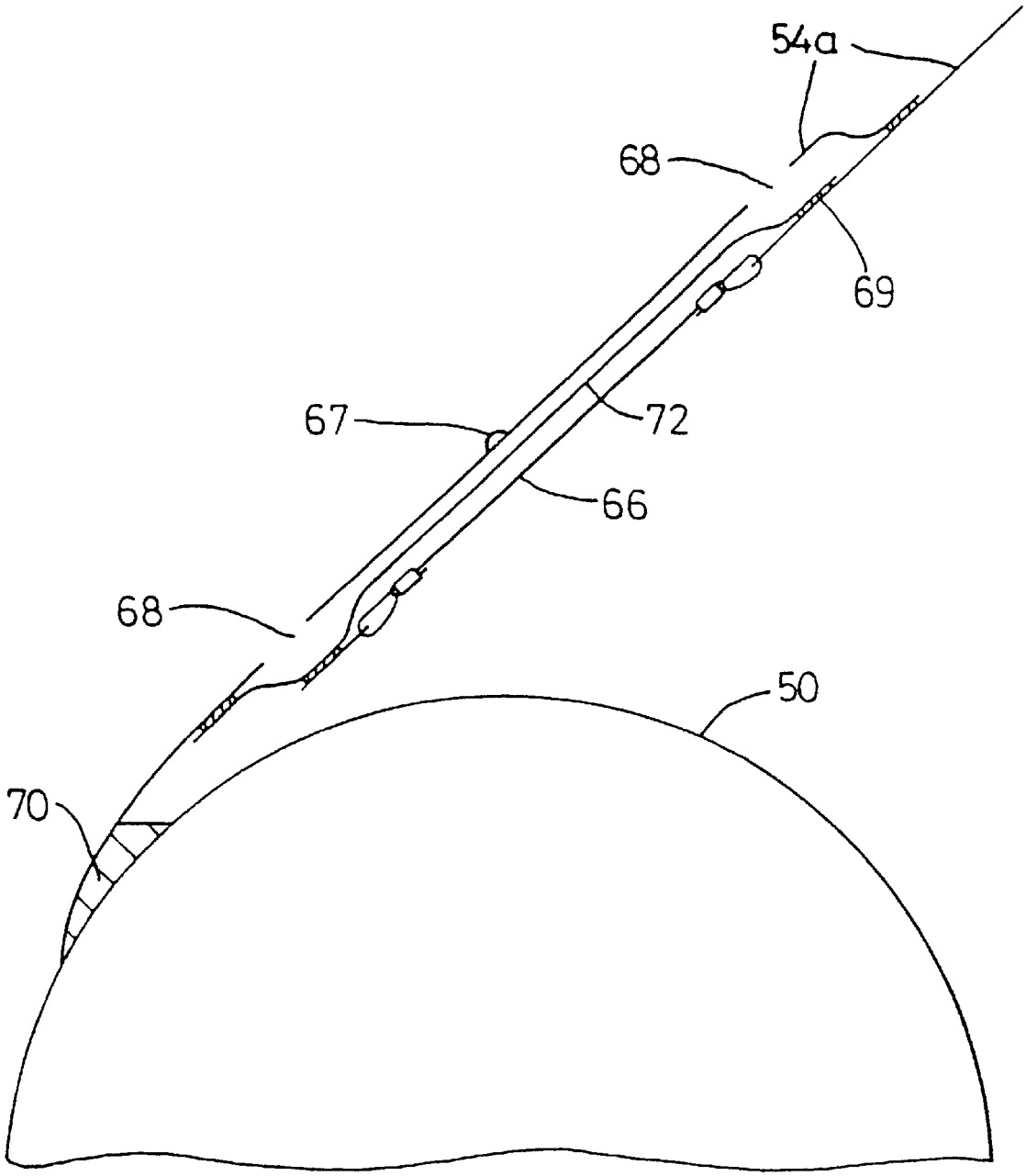
FIG. 7 shows an enlargement of a part of FIG. 6.

At the centre of the sheet 52 is a circular aperture 57 with a part conical sleeve 59 attached around its wider circular end 62 to the periphery of the aperture 57. The other narrow end 64 of the sleeve is attached to the centre 65 of an inflatable column 63 which when inflated is of circular horizontal cross-section and is in the form of two part cones, as can be seen in FIG. 6. The narrow ends of the part cones are at the centre 65 of the column and the wide ends 63*a* and 63*b* are at the top and bottom extremities respectively.

Figure 5:
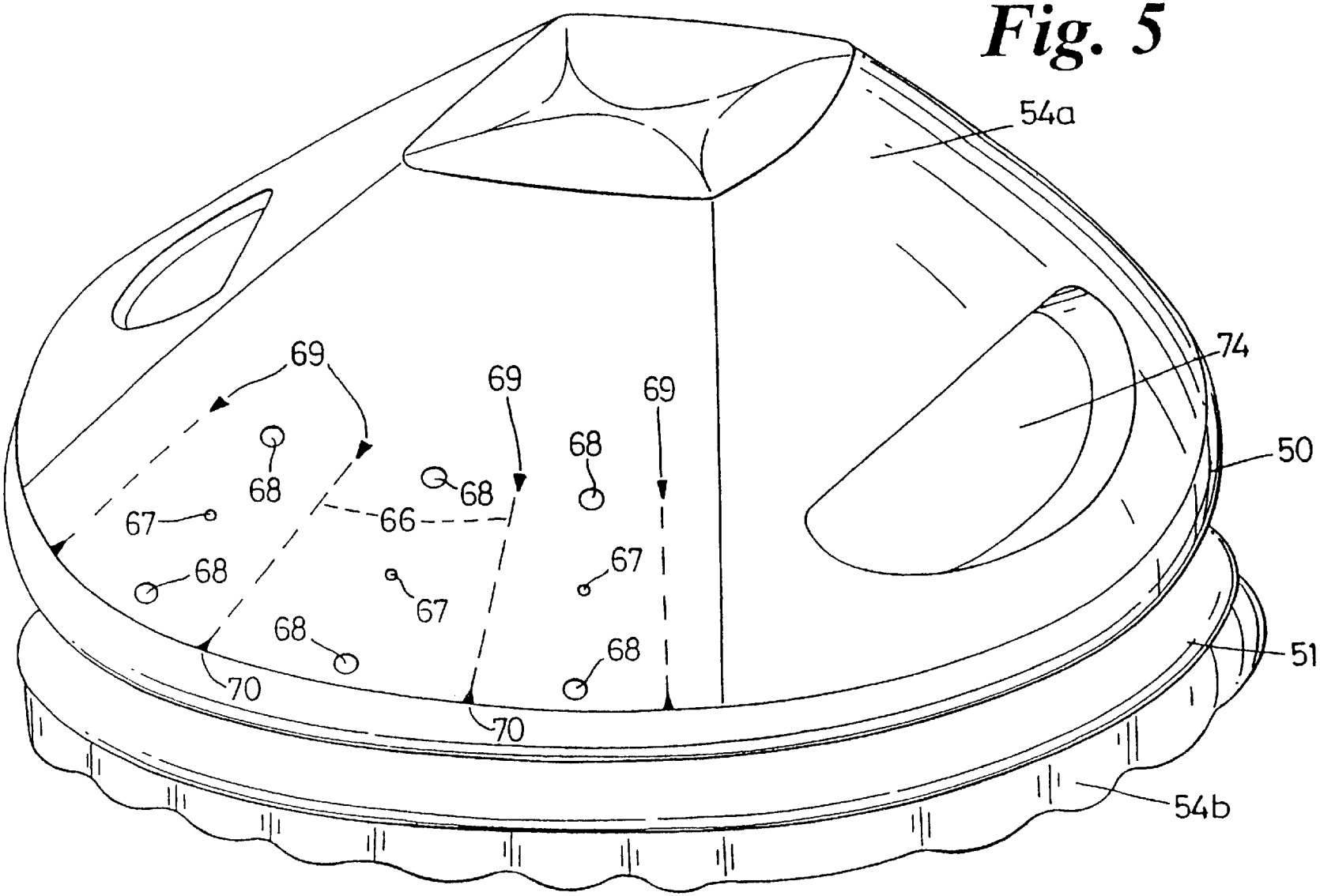
FIG. 5 shows a perspective view from above of an inflated reversible liferaft in accordance with a second embodiment of the invention.

Two canopies 54*a* and 54*b*, each comprising a sheet of waterproof fabric, are provided. Spaced apart around and attached to the canopies is a plurality of spaced-apart weights 67 and a plurality of spaced-apart elasticated ropes 66 (sometimes known as "bungee cords"). (Only some weights and cords are shown in FIG. 1). The elasticated ropes extend away from the positions 70 where canopy 54*a* meets tube 50 and canopy 54*b* meets tube 51 and at their other end are each secured to the respective canopy connections 69 spaced-apart from the respective tube 50 or 51. The weights 17 are positioned approximately midway along the length of the elasticated ropes. (Although the weights appear in FIGS. 6, 7 and 8 to be in the same plane as the elasticated cords, they do not have to be so positioned and may be positioned as shown in FIG. 5). Several spaced apart holes 68 are provided in the canopy. Some are positioned adjacent the tube 50 or 51 and others at positions further from the respective tube 50 and 51 than the weights 67.

A secondary skin 72 of the same fabric as each canopy lies between the respective canopy 54*a* and 54*b* and the elasticated ropes 66.

Figure 8:
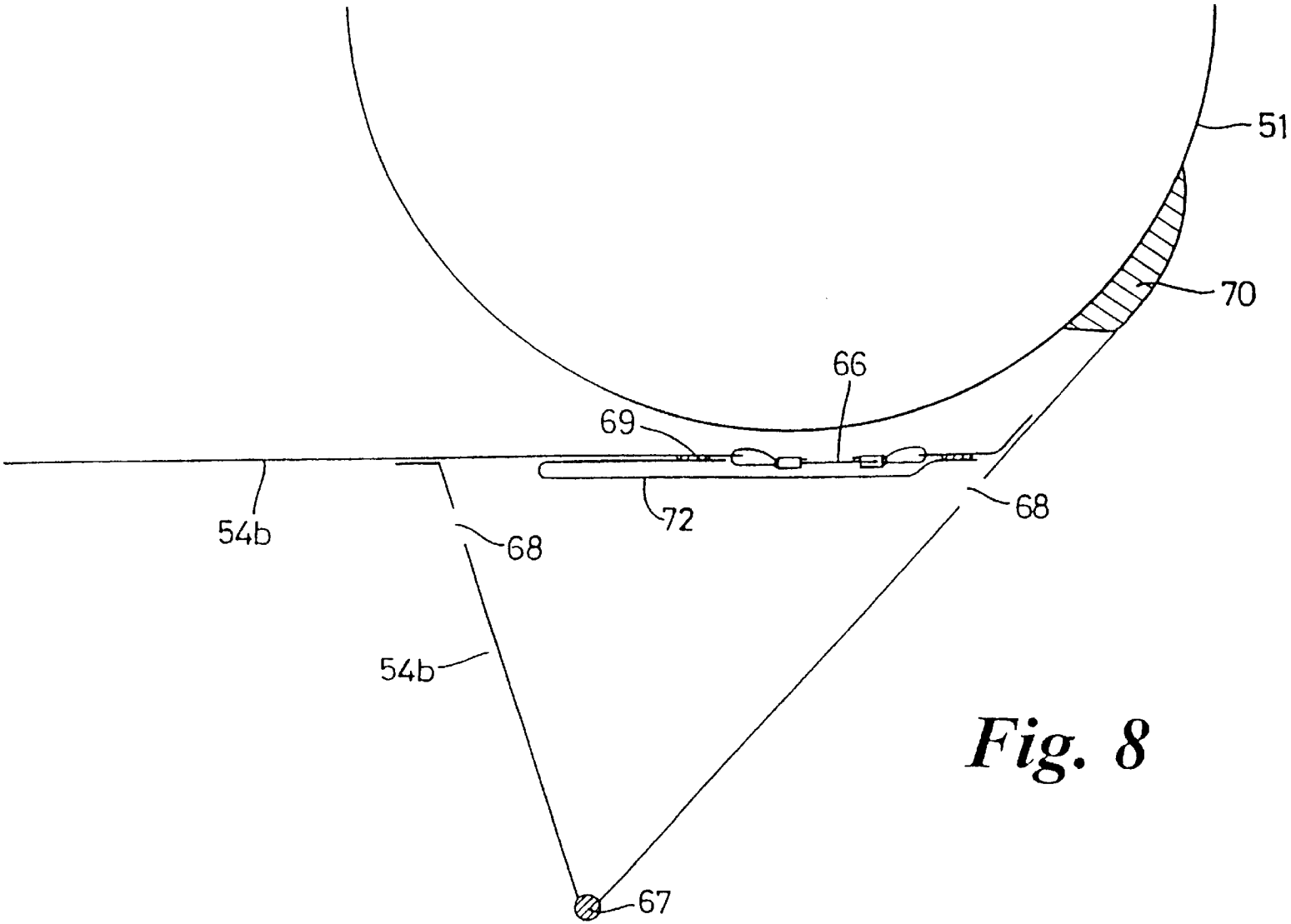
FIG. 8 shows an enlargement of another part of FIG. 6.

As can be seen particularly in FIG. 6, when the liferaft is in the inflated state and floating on water, one canopy 54*a* extends from the upper buoyancy tube 50 and over the top extremity 63*a* of the column 63. The other canopy 54*b* is positioned under the liferaft, extending from the lower tube 61 and under the lower extremity 63*b* of the column 63. Because the liferaft is floating in water, the column 63 is forced upwards due to buoyancy forces and takes up the position shown due to the constraint applied by the sleeve 59 and the upper canopy 54*a*. As can be seen particularly in FIG. 7, the elasticated ropes 66 associated with the upper canopy 54*a* are stretched by the effect of the column on the canopy 54*a*. Because the lower extremity 63*b* of the column 63 does not act on the lower canopy 54*b* the elasticated ropes 66 relax i.e. shorten, and pull on the material of the canopy at the connections 19 and the positions 70 wherein the canopy 54*b* is attached to the lower tube 51. The part of the canopy 54 adjacent the elasticated ropes 66 projects downwards, due to the force applied by the weights 67, so as to have a substantially triangular cross-section as can be seen in FIGS. 6 and 8. The holes 68 in the lower canopy 54*b* allow water to enter into and air to exit from the generally triangular cross-section toroidal space so formed. A plurality of fabric bulkheads 76 may be provided to divide the space into a plurality of circumferentially separate pockets. The overall effect is that the liferaft is provided with stability. The further sheet of fabric 72 on the underside of the liferaft forms into folds and is provided to prevent excess water from flowing from the triangular crosssectional space (preferably divided into pockets) into the liferaft.

As shown in FIG. 6 the column 63 is connected via a flexible feed tube 56 to one (50) of the two buoyancy tubes. The column 63 and buoyancy tube 50 are thus both automatically inflated from the same source (not shown), when the liferaft is deployed in water, an automatic valve system (not shown) ensuring that the tubes 50 and 51 are inflated before the column 63.

Each canopy 54*a* and 54*b* is provided with entrances 74 through which an occupant can climb from the water over the buoyancy tubes 50,51 and into the liferaft. Observation ports or windows (not shown) may also be provided.

When the liferaft is deployed (as shown in the drawings) the outer surface of the upper canopy remains substantially smooth, the pockets which would be formed if the upper canopy were on the underside effectively retract thus preventing fluttering, or in the extreme, whipping, due to wind. Further no obstruction is caused and there are no places where unwanted water due to rain or wave action can collect. The overall construction provides for economical use of fabric.

What is claimed is:

1. A liferaft comprising a sheet of waterproof fabric for supporting at least one person, at least one inflatable tube secured to and surrounding the periphery of the sheet, an aperture formed in the sheet, an inflatable column of fabric having a center and two extremities, a sleeve of waterproof fabric having two ends, the sleeve being connected at one end to the edge of the aperture in the sheet and at the other end to the outer surface of the column at or near the center thereof, and two canopies, each comprising a sheet of fabric extending from one extremity of the column to the at least one inflatable tube and the other extending from the other extremity of the column to the at least one inflatable tube.

2. A liferaft according to claim 1 and comprising two inflatable tubes, one above the other, and the sheet for supporting at least one person is joined to at least one of the tubes at a line of connection between the two tubes.

3. A liferaft according to claim 1 wherein the column has a circular horizontal cross-section when inflated.

4. A liferaft according to claim 1 wherein the column has a narrow center and wider extremities.

5. A liferaft according to claim 4 wherein the wider extremities each have a substantially larger cross-sectional area than that of the center.

6. The liferaft according to claim 5, wherein said wider extremities each having a substantially larger cross-sectional area than that of the center are in the ratio of about 10:1.

7. A liferaft according to claim 1 wherein the column comprises two walls, parts of the two walls being joined together to provide a plurality of flutes when the column is inflated.

8. A liferaft according to claim 1 in that the sleeve is of circular cross-section.

9. A liferaft according to claim 8 wherein the sleeve is of part conical form when the liferaft is inflated.

10. A liferaft according to claim 1 wherein the column is inflatable via a feed tube connected to the at least one inflatable tube.

11. A liferaft according to claim 1 comprising a gas inflation system for the column.

12. A liferaft according to claim 1 wherein at least one water pocket is provided for stability while the liferaft is floating.

13. A liferaft according to claim 1 wherein the canopies are provided with shaping means for causing that part of the canopy which is on the underside of the liferaft when floating on water to project downwards into the water, providing stabilising means for the liferaft.

14. A liferaft according to claim 13 wherein the shaping means is associated with both canopies so that whichever of the two canopies is on the underside of the liferaft is caused to project downwards.

15. A liferaft according to claim 13 wherein the shaping means comprises a plurality of elasticated ropes and weights.

16. A liferaft according to claim 13 wherein the stabilizing means provided when said part of each canopy is shaped by the shaping means comprises at least one water pocket.

17. A liferaft according to claim 16 wherein the water pocket is provided with at least one hole.

18. A liferaft according to claim 16 wherein the water pocket is fitted with at least one transverse bulkhead.

* * * * *